United States Patent [19]

Hogan

[11] 4,228,930

[45] Oct. 21, 1980

[54] DISPENSING PUMP

[75] Inventor: Lawrence R. Hogan, Lake Villa, Ill.

[73] Assignee: Cole-Parmer Instrument Company, Chicago, Ill.

[21] Appl. No.: 831,731

[22] Filed: Sep. 9, 1977

[51] Int. Cl.[2] ..... F04B 43/12

[52] U.S. Cl. ..... 222/212; 222/108; 222/214; 417/477

[58] Field of Search ..... 222/206, 207, 209, 212, 222/214, 215, 571, 108; 417/474, 476, 477

[56] References Cited

U.S. PATENT DOCUMENTS

| | | | |
|---|---|---|---|
| 2,334,148 | 11/1943 | Jones | 417/477 |
| 2,668,637 | 2/1954 | Gilmore | 417/477 |
| 2,721,008 | 10/1955 | Morgan | 222/571 X |
| 3,011,684 | 12/1961 | Corneil | 417/477 |
| 3,781,142 | 12/1973 | Zweig | 417/477 |
| 3,881,641 | 5/1975 | Pliml et al. | 222/207 |

*Primary Examiner*—Joseph J. Rolla

*Attorney, Agent, or Firm*—Fitch, Even, Tabin, Flannery & Welsh

[57] ABSTRACT

A dispensing pump is disclosed for dispensing a fluent material through a compressible conduit having a portion disposed within a pump housing in which is rotatably mounted a rotor operative to effect a peristaltic pumping action on the conduit. An actuating handle is interconnected to the rotor through a unidirectional drive to effect a predetermined quantity discharge upon each movement of the actuating handle in a dispensing direction, and several alternative mechanical arrangements are provided to effect drawback through the conduit to prevent dripping after each discharge while also preventing undesirable back siphoning of the fluent material. In one embodiment, the actuating handle is connected to the rotor through a constant force extension spring operative to effect rotational multiplication of the rotor upon movement of the actuating handle.

15 Claims, 7 Drawing Figures

5.
5.
10
12
14
16
20
22
22'
22a
24
30
34
34'
34a
36
36a
38
40
40a
40b
40c
44
44'
46'
48'
52'
54'
57
58a
58b
60a
60b
62
70
74a
74b
100
102
102a
102b
104
106
110
112a
112b
112c
112d
114
118
120
120b
122
124
124a
126
128
129
130

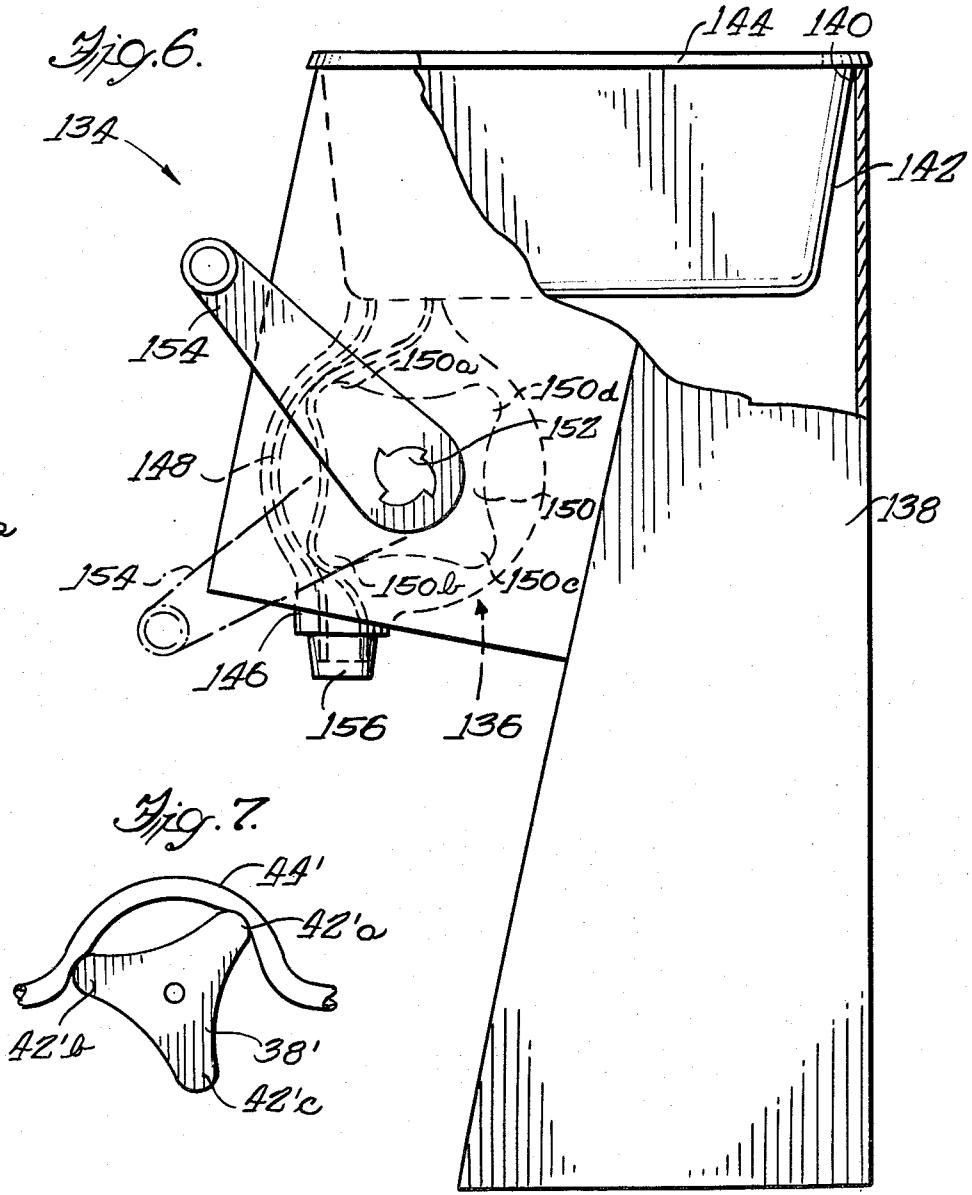
Fig. 6.
Fig. 7.
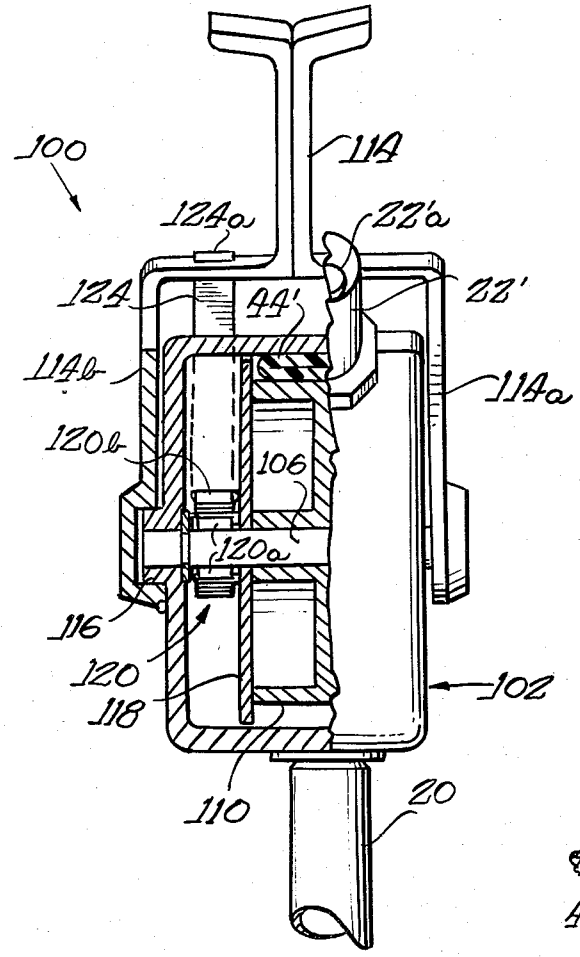
Fig. 5.

DISPENSING PUMP

The present invention relates generally to dispensing pumps, and more particularly to a dispensing pump of the peristaltic type having a novel construction operative to effect discharge of predetermined quantities of fluent material through a compressible conduit without dripping or back siphoning after each discharge.

In dispensing fluent materials, such as certain food products frequently used in restaurants and soda fountains and the like, through dispensing pumps, it is desirable that the dispensers be capable of dispensing fluent materials having particulate matter suspended therein as well as relatively pure fluids. Further desirable features of such dispensing pumps are that they be operative to effect repetitive predetermined quantity discharge without leakage or dripping from the discharge spout, and that they be capable of preventing the fluent material from drawing back into the reservoir after a dispensing cycle so that the pump is prepared for immediate discharge upon initiating its next actuating cycle and does not have to be primed.

In conventional product dispensing techniques as employed in fountain services in dispensing toppings on ice cream and the like, and in restaurants in the making of salads in which a salad dressing is dispensed from a bulk quantity of salad dressing, the toppings and dressings are frequently stored in relatively large bulk containers and dispensed by ladles. This technique has inherent drawbacks in respect to operating time, sanitation and periodic cleanup, not to mention the inconsistency between successive portions dispensed by ladling.

As an alternative to the use of bulk storage containers and ladles, dispensing pump type devices have been developed for dispensing toppings and condiments from bulk containers in fountain services and other food serving establishments. In one such dispensing pump, a piston is depressed to effect discharge of fluent product from a bulk container, and a ball check prevents backflow of the fluent product so as to minimize "spitting" of the product upon subsequent depression of the pump piston. A significant drawback in these pumps is their inability to handle particulate matter such as pickle relish condiments, and strawberry particles and the like found in salad or dessert toppings.

One of the primary objects of the present invention is to provide a dispensing pump which overcomes the disadvantages in the prior art dispensing pumps through the provision of a novel dispensing pump particularly suited for dispensing fluent products having particulate matter carried in suspension therein.

Another object of the present invention is to provide a novel dispensing pump for use in dispensing fluent materials through a peristaltic pumping action on a tubular conduit to effect passage of fluent material therethrough, the pump having novel means for effecting slight drawback of material within the tube to prevent leaking and dripping from the discharge end thereof.

Still another object of the present invention is to provide in one embodiment a rotor actuated through an actuating handle interconnected to the rotor through an extension spring operative to effect a rotational multiplication of the rotor upon a predetermined movement of the operating handle, the extension spring having a memory operative to return the actuating handle to a home position when the actuating handle is released.

Another object of the present invention is to provide a dispensing pump operative to dispense a fluent product by a peristaltic action on a compressible fluid conduit, the pump having an actuating handle interconnected to a rotor through a unidirectional drive mechanism operative to effect rotation of the rotor in a predetermined discharge direction upon predetermined movement of the actuating handle.

A feature of the dispensing pump in accordance with the present invention lies in the provision of means mounted on the pump housing for selectively restricting the cross sectional flow area of the compressible flow tube so as to facilitate substantially equal quantity dispensing of fluent materials having different viscosities.

Further objects and advantages of the present invention, together with the organization and manner of operation thereof, will become apparent from the following detailed description of the invention when taken in connection with the accompanying drawings wherein like reference numerals designate like elements throughout the several views, and wherein:

FIG. 5 is a fragmentary longitudinal sectional view taken substantially along the line 5—5 of FIG. 4;

FIG. 6 is a side elevational view of a top load dispensing apparatus employing a dispensing pump in accordance with the present invention, with portions broken away for clarity; and FIG. 7 schematically illustrates an alternative manner of obtaining drawback in the compressible tubular conduits employed in the dispensing pumps of FIGS. 1 and 4.

Figure 2:
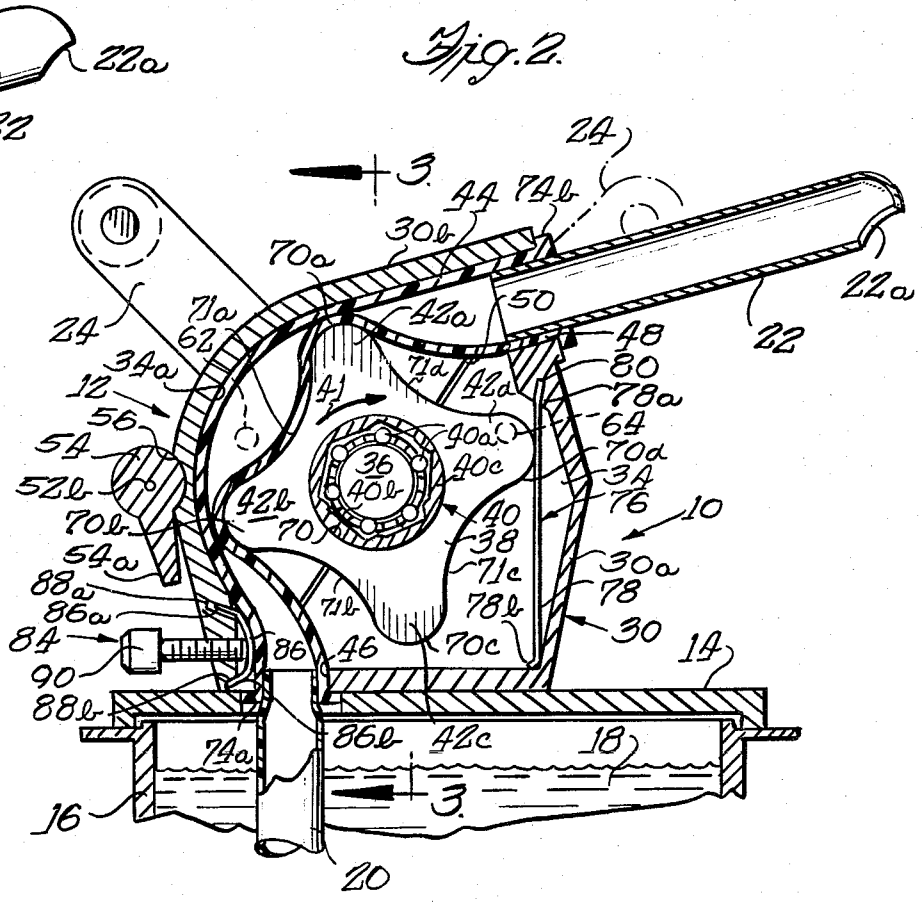
FIG. 2 is a fragmentary transverse sectional view of the dispensing apparatus of FIG. 1.
Figure 1:
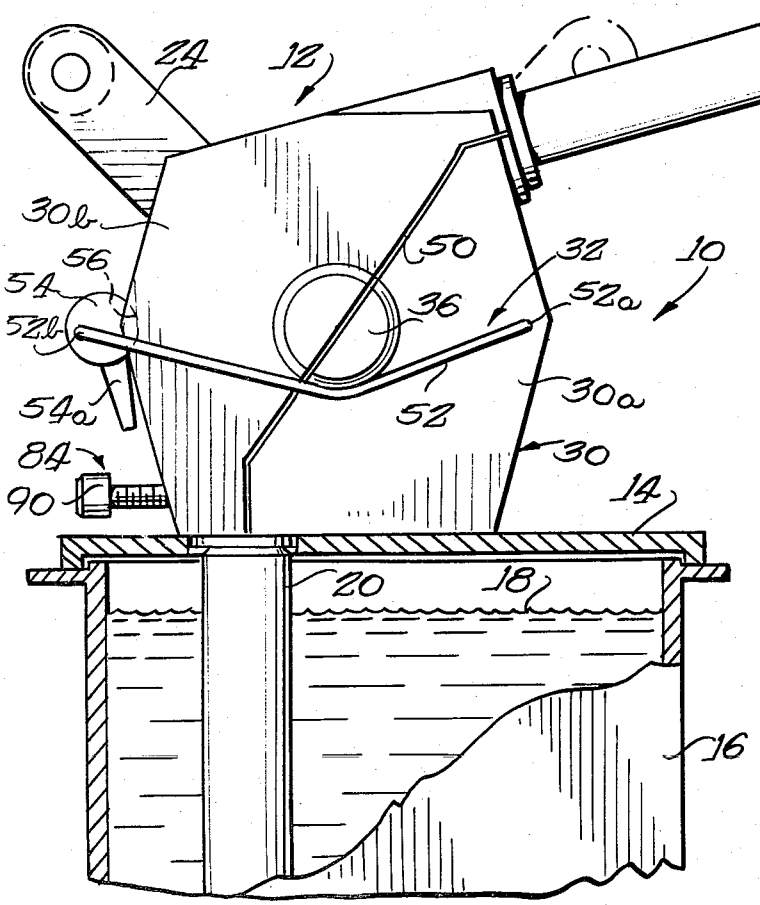
FIG. 1 is a fragmentary side elevational view of a dispensing apparatus employing a dispensing pump in accordance with one embodiment of the present invention, portions of the reservoir being broken away for clarity.
Figures 3, 4:
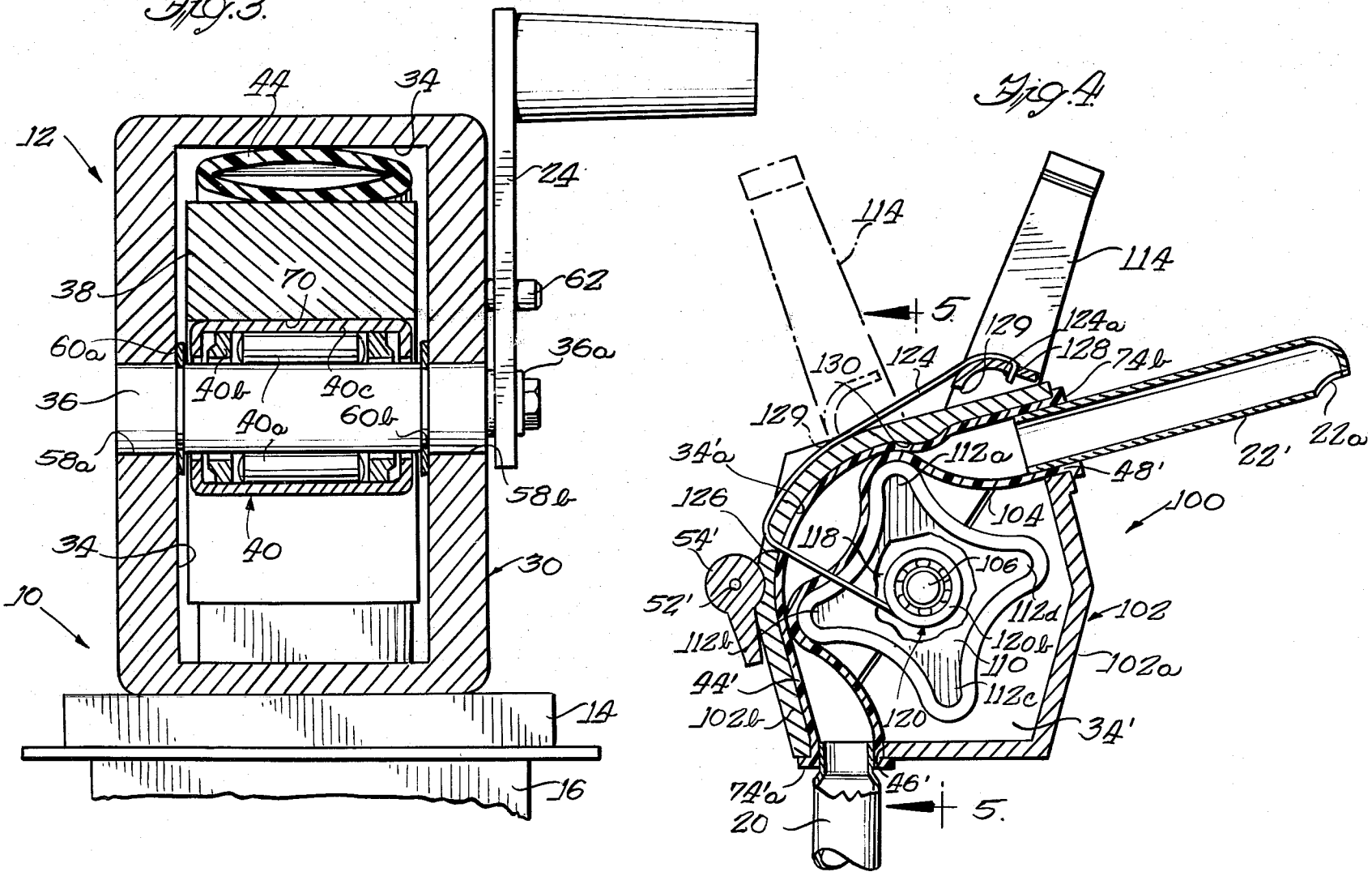
FIG. 3 is an enlarged fragmentary longitudinal sectional view taken substantially along the line 3—3 of FIG. 2, looking in the direction of the arrows.
FIG. 4 is a fragmentary transverse sectional view of a dispensing pump constructed in accordance with an alternative embodiment of the present invention.

Referring now to the drawings, and in particular to FIGS. 1-3, a dispensing apparatus for dispensing fluent products such as dessert toppings, salad dressings and condiments and the like is indicated generally at 10. The dispensing apparatus 10 includes a dispensing pump, indicated generally at 12, which, by way of illustration, is shown mounted on an upper cover 14 of a standard fountain reservoir or jar 16 as may be employed in soda fountain counters, restaurants, or other facilities where various fluent food products such as sauces, toppings and condiments are stored in bulk quantities and dispensed in predetermined individual servings therefrom. Such a fluent product is indicated at 18 in the fountain reservoir 16 and is adapted to be drawn upwardly through a depending tubular conduit 20 by the pump 12 and dispensed through a dispensing tube 22 forming a part of the pump 12.

As will become more apparent hereinbelow, the pump 12 is adapted to dispense the fluent product 18 in controlled predetermined quantities through the operation of an operating handle 24 without messy or wasteful dripping from the discharge end of the dispensing tube 22. Additionally, the pump 12 is adapted to prevent the fluent product from siphoning back into the reservoir 16 between successive dispensing cycles, thusassuring dispensing of a full predetermined quantity of the fluent product during each operating movement of the handle 24 without requiring "priming" of the pump with its attendant time delays in advancing the fluent product to the outlet end of the dispensing outlet tube 22. It will also become apparent that the pump 12 in accordance with the present invention, through its positive peristalic pumping action, is adapted to readily dispense fluent products having particulate matter such as seeds, skins or fibers suspended therein. The latter feature is a significant advantage over the known prior dispensing pumps which have not been capable of suitably dispensing suspensions of particulate matter.

The dispensing pump 12 includes a housing 30 having two separable housing sections 30*a* and 30*b* normally retained in assembled relation by a retaining bracket or clip indicated generally at 32. As best seen in FIGS. 2 and 3, the housing 30 defines an internal chamber 34 through which extends an actuating shaft 36 the axis of which defines the longitudinal axis of the housing 30. The actuating shaft 36 extends outwardly of the housing 30 for connection to the operating handle 24 and supports a rotor 38 within the chamber 34 through unidirectional drive means, indicated generally at 40, so as to effect rotation of the rotor 38 in the direction of the arrow 41 upon selective movement of the actuating handle 24 from the position shown in solid lines in FIG. 2 to the position shown in phantom.

The rotor 38 defines a plurality of compression lobes which during rotation of the rotor 38 effect a peristaltic pumping action on a compressible tubular conduit 44 disposed within the chamber 34 so as to effect the flow of fluent product 18 upwardly through the tube 20, through the flow conduit 44 and outwardly through the dispensing tube 22. In the illustrated embodiment, four compression lobes 42*a–d* are formed on rotor 38 in equidistantly circumferentially spaced relation about the axis of the rotor. However, it will be appreciated that while four compression lobes 42*a–d* are preferred on the rotor 38, fewer or more than four compression lobes may be provided on the rotor. For example, three compression lobes might be preferred spaced 120 degrees apart about the axis of the rotor.

The pump housing 30 has a pair of circular openings 46 and 48 therein which receive the opposite ends of the compressible tubular conduit 44. In the illustrated embodiment, the opening 46 defines the entrance opening in the housing 30, while the opening 48 defines the exit opening. The separable pump housing sections 30*a* and 30*b* define a parting plane 50 therebetween which intersects and is coplanar with the axis of the actuating shaft 36, and also intersects the openings 46 and 48 in coplanar relation with their axes. With the housing sections separated, access is readily provided to the internal compressible tubular conduit 44 and to the rotor 38 and associated unidirectional drive means 40.

To retain the housing sections 30*a* and 30*b* in assembled closed relation, the retaining bracket 32 includes a generally U-shaped rod 52 which has ends 52*a* pivotally connected to the housing section 30*a* and carries a cylindrical cam lock 54 eccentrically on a cross-over end 52*b* to facilitate cam action engagement of the cam lock with a recess 56 in the housing section 30*b*. The cam lock 54 preferably has a finger hold 54*a* formed thereon to facilitate manipulation in effecting locking and unlocking engagement with the recess 56.

The actuating shaft 36 is rotatably journaled within aligned bores 58*a*, 58*b* formed between the mating housing sections 30*a*, *b* so as to facilitate assembly of the actuating shaft and associated rotor 38 within either of the housing sections, preferably housing section 30*b*, when the housing sections are separated. The actuating shaft 36 is fixed axially within the pump housing by annular retainer rings 60*a*, 60*b* received within suitable annular grooves in the actuating shaft, as best seen in FIG. 3. The operating handle 24 is mounted on an outwardly extending end portion 36*a* of actuating shaft 36 and is pivotally movable between a rearward position defined by a rear stop pin 62 mounted on the housing section 30*b* and a forward position defined by a forward stop pin 64 mounted on the housing section 30*a*.

The rotor 38 is mounted on the actuating shaft 36 through the unidirectional drive means 40 so that pivotal movement of the operating handle 24 from its rearward to its forward position engaging the stop 64 effects a corresponding rotational movement of the rotor, while reverse movement of the operating handle to again engage the rear stop 62 does not effect a corresponding reverse rotation of the rotor. The rotor compression lobes 42*a–d* have semi-cylindrical outer compression surfaces 70*a–d*, respectively, formed thereon equally radially spaced from the axis of rotation of the rotor. It is seen from FIG. 2 that recessed areas 71*a–d* are formed between the lobes 42*a–d* and associated compression surfaces 70*a–d* so that the compression surfaces engage the compressible conduit 42 at localized areas and effect successive moving regions of compression along the longitudinal length of the conduit during rotation of the rotor. If desired, the compression surfaces on the rotor 38 may be defined by the outer peripheral surfaces of cylindrical rollers suitably mounted on the rotor for rotation about axes parallel to the axis of rotation of the rotor, as is known.

To facilitate compression or occlusion of the compressible conduit 44, the chamber 34 includes a confining surface 34*a* shaped in the form of an arcuate segment of a cylinder having its axis coincident with the axis of actuating shaft 36. The confining surface 34 *a* cooperates with each rotor compression surface 70*a–d* for a period of approximately one-quarter revolution of the rotor 38 so that each compression surface establishes a moving region of total occlusion for one-quarter of each rotor revolution. In the illustrated embodiment, the rotor 38 is supported on the actuating shaft 36 through the unidirection drive means 40 in such a manner that two of the compression surfaces 60*a–d* totally occlude the compressible conduit 44 at all times between each cycle of the operating handle 24, i.e. when the operating handle is in its rearward position against stop 62.

The unidirectional drive means 40 comprises a roller clutch of known design which includes a plurality of cylindrical rollers 40*a* maintained in circumferentially spaced relation by an annular cage 40*b* and cooperative with an outer driven cam ring 40*c* fixed within a bore 72 in rotor 38 so that rotation of the actuating shaft 36 in a clockwise direction, as considered in FIG. 2, is operative to effect a corresponding rotational movement of the rotor 38. Rotation of the actuating shaft 36 in an opposite or counterclockwise direction effects an overrun mode wherein the actuating shaft is free to rotate relative to rotor 38.

The compressible tubular conduit 44 is preferably made from a suitable urethane or silicone material which has sufficient lubricity for low wear sliding relation with the rotor 38 which may be made of a suitable plastic. Annular flanges 74*a* and 74*b* are formed at the opposite ends of the conduit 44 for engagement with the closed housing sections 30*a, b* to fix the tubular conduit within the chamber 34. With the pump 12 mounted on the fountain reservoir cover 14, the inlet tube 20 is inserted into the conduit 44 within the entrance opening 46, and the dispensing tube 22 is inserted into the opposite end of the conduit 44 within the housing opening 48. The reservoir cover 14 may then be positioned on the reservoir 16.

In the operation of the dispensing pump 12 thus far described, movement of the operating handle 24 through approximately 90° from its rearward position abutting the stop 62 to its forward position abutting the stop 64 effects a corresponding 90° rotation of the rotor 38. As noted, the rotor 38 is initially synchronized with the operating handle such that two of the compression surfaces 70*a–d* effect full occlusion of the conduit 44 when the operating handle is in its rearward position. Forward movement of the operating handle thus creates moving region of occlusion or compression along the conduit 44 which causes a suction action on the fluent product within the reservoir 16 to draw the product upwardly into the tube 44. After initially "priming" the pump 12 to fill the conduit 44, each successive forward movement of the operating handle 24 causes a predetermined quantity of fluent product to be captured between each successive pair of compression lobes 42*a–d* and moved along the conduit 44 for discharge through a discharge opening 22*a* in the dispensing tube 20.

To prevent undesired dripping of fluent product from the dispensing tube 20, resilient biasing means, indicated generally at 76, is mounted within the pump housing chamber 34 for cooperative relation with the rotor 38 to bias the rotor in a reverse rotational direction each time the operating handle 24 is moved from its forward position toward its rearward position. In the embodiment illustrated in FIG. 2, the biasing means 76 comprises a resilient leaf spring 78 having an end portion 78*a* secured within a suitable slot 80 in the housing section 30*a*. A free end 78*b* of the leaf spring 78 opposite the mounting end 78*a* is adapted to engage the housing 30*a* so as to position the leaf spring in the path of movement of the compression lobes 42*a–d* as the rotor 38 is rotated. The leaf spring 78 is adapted to exert a slight reverse rotation bias on the rotor 38 after each 90° advance rotation thereof, or 120° advance rotation in the case of a three lobe rotor, so that as the operating handle 24 is initially moved from its forward position toward its rearward position, the rotor 38 is rotated slightly in a counterclockwise direction, as considered in FIG. 2, to effect a sucking action on the fluent product within the dispensing tube 22 sufficient to withdraw the fluent product from the lip of the discharge opening 22*a*.

It will be understood that biasing means other than the resilient leaf spring 78 may be provided to effect a slight reverse rotation of the rotor 38 upon each movement of the operating handle 24 from its forward to its rearward position so as to effect a slight product "drawback" from the discharge opening 22*a*. For example, a rubber bumper or fluid cushion of known design might be mounted within the pump housing 30 to engage the compression lobes 42*a–d* during advance rotation of the rotor 38 so as to establish potential energy which is released to rotate the rotor in a slight reverse rotation each time the operating handle is moved from its forward position toward its rearward position.

To facilitate usage of the dispensing pump 12 with fluent products having different viscosities while maintaining uniform quantity discharge from the dispensing tube 22, the pump 12 includes means, indicated generally at 84, to selectively vary the cross-sectional flow area of the inlet end of the compressible conduit 24, thereby making more or less fluent product available for entrapment between the rotor compression lobes 42*a–d*. The tube flow varying means 84 includes a tube compressing member 86 having upper and lower legs 86*a, b* received, respectively, within grooves 88*a, b* in the housing section 30*b* so that the member 86 is free to move in a direction transverse to the axis of the tube 44. An adjustable screw 90 is received within a threaded bore in the housing 30*b* and has its inner end engaging compressing member 86 to selectively compress and reduce the internal flow capacity of the tube 44 at its entrance end.

FIGS. 4 and 5 illustrate another embodiment of a dispensing pump, indicated generally at 100, which may be employed in dispensing fluent product from a bulk container such as the reservoir 16. The dispensing pump 100 includes a housing 102 having two separable housing sections 102*a, b* adapted to be closed along a parting plane 104 which is coplanar with the axis of a rotatable actuating shaft 106 and the axes of inlet and outlet openings 46' and 48' in the housing. A compressible tubular conduit 44' is fixed internally of the housing 102 by annular end flanges 74'*a* and 74'*b* cooperable with the housing sections 102*a, b* when retained in closed positions by a closing bracket 52' and associated cam lock 54'.

The pump 100 includes an internal rotor 110 which is fixedly mounted on the actuating shaft 106 and defines four compression lobes 112*a–d* adapted to engage the conduit 44' during rotation of the rotor to effect a peristaltic pumping action on the compressible conduit and cause flow of fluent product therethrough for discharge from a dispensing tube 22' in similar fashion to the aforedescribed dispensing pump 12.

The dispensing pump 100 differs from the dispensing pump 12 primarily in that the actuating shaft 106 is interconnected to an operating lever or handle 114 so that pivotal movement of the operating handle through approximately 90° is operative to effect a full revolution of the rotor 110. The operating handle 114 has bifurcated arm portions 114*a* and 114*b* pivotally mounted on outwardly extending bosses 116 defined by the assembled housing sections 102*a, b*. The operating handle 114 is adapted to be manually grasped so that the force applied to effect operating movement thereof acts in a plane substantially perpendicular to the axis of the housing 102 and intermediate its axial end walls. In this manner, force moments which might otherwise tend to cock the housing relative to the associated product reservoir on which it may be mounted are eliminated.

It is seen from FIG. 5 that the rotor 110 is mounted in off-center relation on the actuating shaft 106 and has an annular plate 118 affixed to one end of the rotor to isolate a unidirectional drive means 120 between plate 118 and the pump housing. The unidirectional drive means 120 preferably comprises a roller clutch having cylindrical rollers 120*a* cooperable with an outer cam ring 120*b* similar to the aforedescribed rollers 40*a* and cam ring 40*a*.

The constant force extension spring 124 is secured at its inner end to the outer cam ring 120*b* of the unidirectional drive means 120 and is adapted to be coiled about the outer cam ring. An outer end 124*a* of the spring 124 passes through an opening 126 in the housing section 102*b* and is secured to the operating handle 114 through a suitable slot 128 therein, as best seen in FIG. 4. The constant force extension spring 124 is of known design and has inherent resilient biasing to maintain a coiled memory position on cam ring 120*b*. In this manner, the constant force extension spring 124 biases the operating handle 114 to a rearward position relative to the housing 102, such rearward position being established by engagement of a stop surface 129 on handle 114 with the housing 102 as shown in phantom in FIG. 4. Movement of the operating handle 114 in a forward direction effects clockwise rotation of the actuating shaft 106 and rotor 110 through the roller clutch 120, as considered in FIG. 4, while release of the operating handle allows the extension spring to again coil itself about the outer cam ring 120*b* which is prevented from reverse rotation on the shaft 106 by rollers 120*a*. Recoiling of the spring 106 causes the operating handle to return to its rearward position. In the illustrated dispensing pump 100, the extension spring 124 and roller clutch 120 are selected so that movement of the operating handle 114 through a forward pivotal angle of approximately 80° effects approximately 360° rotation of the rotor 110.

The pump 100 includes alternative means to effect a slight drawback of the fluent product within the dispensing tube 22' so as to prevent dripping after each dispensing cycle. Such drip preventing means includes a camming ramp surface 130 formed on the confining surface 34'*a* within the pump chamber 34' at a predetermined position for cooperation with successive ones of the compression lobes 112*a–d* during rotation of the rotor 110. The ramp surface 130 is located at a position such that as the operating handle 114 reaches its forward limit position, one of the compression lobes 112*a–d* is positioned adjacent the ramp surface and effects a slightly greater compression of the conduit 44' than effected by the compression lobes on the conduit prior to reaching the ramp surface position, as best seen in FIG. 4. In this manner, when the operating handle 114 is released, the inherent flexure characteristics of the tubular conduit 44 which tend to return the conduit to its normal uncompressed condition act between the ramp surface 130 and the adjacent compression lobe to exert a force on the rotor 110 tending to rotate it slightly in a reverse rotational direction. Such slight reverse rotation of the rotor effects sufficient drawback of fluent material within the dispensing tube 22' to prevent dripping from the discharge opening 22'*a*.

It will be appreciated that in both the dispensing pumps 12 and 100, the unidirectional drive means illustrated as roller clutches may alternatively take the form of pawl and ratchet mechanisms or the like of known design, it being only necessary that such unidirectional drive means effect substantially unidirectional rotation of the rotors in response to selective actuation of the respective operating handles 24 and 114.

FIG. 6 illustrates a top load dispensing apparatus, indicated generally at 134, employing a dispensing pump 136 in accordance with the present invention. The dispensing apparatus 134 includes an upstanding frame or cabinet 138 having a rectangularly shaped open upper end 140 in which is mounted a reservoir 142 adapted to receive a bulk quantity of fluent product such as salad dressing, dessert topping or the like. A removable cover 144 overlies the reservoir 142 for closing the same in a conventional manner.

The pump 136 includes a pump housing 146 suitably supported within the cabinet 138 adjacent the reservoir 142 to facilitate connection of a compressible tubular conduit 148 to the reservoir for communication with the interior thereof. The tubular conduit 148 passes internally of the pump housing 146 where it is engaged by successive compression lobes 150*a–d* on a rotor 150 having substantially identical configuration to the aforedescribed rotor 38. The rotor 150 is mounted on an actuating shaft 152 through unidirectional clutch means (not shown) in similar fashion to mounting of the rotor 38 on the actuating shaft 36. An operating lever or handle 154 is mounted on an outer end of the shaft 152 and is operable to effect a peristaltic pumping action on the conduit 148 by the rotor 150 to dispense fluent product from the reservoir 142 through a dispensing tube outlet 156 into a suitable receptacle.

Stop pins (not shown) are preferably mounted on the cabinet 138 to define upper and lower limits of movement for the operating handle 154 during successive dispensing cycles. The rotor 150 is mounted on the shaft 152 so that when the handle 154 is in its upper position, two of the compression lobes 150*a–d* fully occlude the conduit 148 so as to prevent downward flow from the reservoir 142. By occluding the conduit 148 in two areas, failure of the conduit at one area of occlusion will not result in undesirable discharge of fluent product. Suitable means (not shown) may also be provided within the pump housing 146 to bias the rotor 150 in a slight reverse rotation each time the operating handle reaches its downward position so as to create a slight drawback of product within the discharge end of the conduit 148 and prevent dripping therefrom.

FIG. 7 schematically illustrates still another manner of obtaining "drawback" of product from the discharge opening in a dispensing tube. In the embodiment shown in FIG. 7, a portion of a length of compressible tubular conduit is indicated at 160 in cooperation with a rotatable rotor 162 having three compression lobes 162*a–c* spaced 120° about the rotational axis of the rotor. The compressible tube 160 is provided with an arcuate extent sufficient to be occluded by two of the rotor compression lobes at the conclusion of each incremental rotational advance of the rotor so that upon removal of the force advancing the rotor, the invested energy stored in the tube at the regions of compression causes rotor reversal which in turn provides slight product reversal or "drawback".

It is seen that the peristaltic dispensing pumps in accordance with the present invention are capable of dispensing fluent products having particulate matter suspended therein without concern for possible malfunction of check valves as employed in the known prior art fountain type dispensing pumps to prevent back siphoning of the fluent product into the supply reservoir. Additionally, by causing two compression lobes on the rotors 38 and 100 to contact their respective compressible conduits so as to fully occlude the conduits in two different areas after each movement of the operating handles to their forward dispensing positions, failure by breakage or wear of the compressible conduits at one area of occlusion will not cause the fluent material to siphon back into the reservoir from which the fluent product is being drawn. This feature is particularly significant to prevent loss of fluent product from a bulk supply reservoir when the pump is mounted below the fluent material reservoir as in FIG. 6. Still further, it is seen that by providing means for varying the flow area of the input end of the compressible conduit through which the fluent product passes, the dispensing pump 12 may be adjusted to dispense substantially equal quantities of fluent materials having different viscosities.

While preferred embodiments of the present invention have been illustrated and described, it will be understood to those skilled in the art that changes and modifications may be made therein without departing from the invention in its broader aspects. Various features of the invention are called for in the following claims.

What is claimed is:

1. A dispensing pump comprising a housing defining an internal chamber, a compressible tubular conduit having a portion disposed within said chamber and adapted to pass a fluent material therethrough, actuating means including an actuating shaft rotatably supported by said housing and extending into said chamber, a rotor mounted on said actuating shaft for rotation therewith in said chamber, said rotor defining a plurality of compression surfaces circumferentially spaced about the axis of rotation of said rotor radially equidistant therefrom, said internal chamber defining a confining surface spaced from said rotor so that rotation of said rotor effects engagement of successive compression surfaces with said conduit to form moving regions of occlusion along said conduit and move fluent material confined between successive regions of occlusion along said conduit, unidirectional drive means interconnecting said actuating means to said rotor so that rotation of said actuating shaft in a predetermined rotational direction effects a corresponding predetermined rotation of said rotor, and means supported within said internal chamber for cooperation with said rotor upon said predetermined rotation thereof so as to bias said rotor in a rotational direction opposite said predetermined rotation each time said rotor completes said predetermined rotation, whereby fluent material in said conduit downstream from said rotor is caused to be drawn back from a dispensing end of said conduit to prevent dripping therefrom.

2. A dispensing pump as defined in claim 1 wherein said means biasing said rotor in said opposite rotational direction comprises a resilient spring adapted to be engaged by each of said compression surfaces upon rotation of said rotor, said spring being positioned to bias said rotor in said opposite rotational direction upon completion of each incremental movement of said rotor to effect a predetermined discharge of fluent material from said conduit.

3. A dispensing pump as defined in claim 1 wherein said rotor defines at least four compression surfaces thereon, said rotor being cooperable with said confining surface to establish at least two occlusions of said conduit after each dispensing cycle.

4. A dispensing pump as defined in claim 1 wherein the longitudinal axis of said actuating shaft defines the longitudinal axis of said housing, said housing having a pair of openings communicating with said internal chamber which receive said tubular conduit therethrough, said openings having axes lying in a plane substantially perpendicular and transverse to said longitudinal axis of said housing, said housing comprising two housing sections defining a parting plane therebetween coplanar with said longitudinal axis and containing said axes of said openings, said housing sections being moveable between relative closed positions enclosing said rotor and relative open positions wherein said actuating shaft may be supported on both ends by one of said housing sections and providing access to said rotor.

5. A dispensing pump as defined in claim 4 wherein said housing sections are relatively movable between open and closed positions, and including means cooperable with said housing sections for releasably maintaining them in their said closed positions.

6. A dispensing pump comprising a housing defining an internal chamber, a compressible tubular conduit having a portion disposed within said chamber and adapted to pass a fluent material therethrough, an actuating shaft rotatably supported by said housing and extending into said chamber, a rotor mounted on said actuating shaft for rotation therewith in said chamber, said rotor defining a plurality of compression surfaces circumferentially spaced about the axis of rotation of said rotor radially equidistant therefrom, said internal chamber defining a confining surface spaced from said rotor so that rotation of said rotor effects engagement of successive compression surfaces with said conduit to form moving regions of occlusion along said conduit and move fluent material confined between successive regions of occlusion along said conduit, unidirectional drive means interconnecting said actuating means to said rotor so that rotation of said actuating shaft in a predetermined rotational direction effects a corresponding predetermined rotation of said rotor, an operating handle pivotally mounted on said housing, and a constant force extension spring interposed between said operating handle and said unidirectional drive means to effect said corresponding predetermined rotation of said rotor upon pivotal movement of said operating handle in a predetermined direction, said extension spring having a memory adapted to return said actuating handle to a predetermined position upon release of said operating handle following each movement thereof to effect discharge from said pump.

7. A dispensing pump as defined in claim 6 wherein said extension spring is adapted to effect a substantially greater angular rotation of said rotor than the pivot angle traversed by said operating handle upon each said predetermined pivotal movement thereof.

8. A dispensing pump as defined in claim 7 wherein said extension spring is adapted to effect a full revolution of said rotor upon each pivotal movement of said operating handle less than a full revolution thereof in a discharge direction.

9. A dispensing pump comprising a housing defining an internal chamber, a compressible tubular conduit having a portion disposed within said chamber and adapted to pass a fluent material therethrough, actuating means including an actuating shaft rotatably supported by said housing and extending into said chamber, a rotor mounted on said actuating shaft for rotation therewith in said chamber, said rotor defining a plurality of compression surfaces circumferentially spaced about the axis of rotation of said rotor radially equidistant therefrom, said internal chamber defining a confining surface spaced from said rotor so that rotation of said rotor effects engagement of successive compression surfaces with said conduit to form moving regions of occlusion along said conduit and move fluent material confined beteen successive regions of occlusion along said conduit, and unidirectional drive means interconnecting said actuating means to said rotor so that rotation of said actuating shaft in a predetermined rotational direction effects a corresponding predetermined rotation of said rotor, said housing including at least two openings therein communicating with said internal chamber, said compressible conduit being disposed within said openings and defining an entrance for connection to an external source of fluent material, and including a contact plate supported by said housing within said chamber in contact with said compressible conduit, and an adjustable screw mounted on said housing and operatively associated with said contact plate in a manner to enable lateral compression of said conduit by said contact plate so as to selectively vary the cross-sectional flow area of said conduit.

10. A dispensing pump as defined in claim 9 wherein said means for selectively varying the flow area of said conduit is supported by said housing adjacent said entrance opening.

11. A dispensing pump comprising a housing defining an internal chamber, a compressible tubular conduit having a portion disposed within said chamber and adapted to pass a fluent material therethrough, actuating means including an actuating shaft rotatably supported by said housing and extending into said chamber, a rotor mounted on said actuating shaft for rotation therewith in said chamber, said rotor defining a plurality of compression surfaces circumferentially spaced about the axis of rotation of said rotor radially equidistant therefrom, said internal chamber defining a confining surface spaced from said rotor so that rotation of said rotor effects engagement of successive compression surfaces with said conduit to form moving regions of occlusion along said conduit and move fluent material confined between successive regions of occlusion along said conduit, and unidirectional drive means interconnecting said actuating means to said rotor so that rotation of said actuating shaft in a predetermined rotational direction effects a corresponding predetermined rotation of said rotor, said confining surface in said internal chamber being generally arcuate so as to effect substantially equal moving regions of occlusion along said conduit upon rotation of said rotor, said confining surface having a ramping surface formed thereon at a predetermined location for cooperation with said conduit and said rotor so as to bias said rotor in a rotational direction opposite to said predetermined rotation thereof after each predetermined discharge from said pump whereby to effect a drawback of fluent material from a discharge end of said conduit.

12. A dispensing pump as defined in claim 11 wherein said actuating means includes an operating handle cooperable with said actuating shaft to effect selective rotation thereof, said operating handle having a manually engageable portion positioned so that the force applied thereto in effecting said selective rotation of said actuating shaft acts in a plane transverse to the longitudinal axis of said housing substantially at its midpoint.

13. A dispensing pump comprising a housing defining an internal chamber, a compressible tubular conduit having a portion disposed within said chamber and adapted to pass a fluent material therethrough, actuating means including an actuating shaft rotatably supported by said housing and extending into said chamber, said actuating means further including an operating handle mounted on said actuating shaft externally of said housing, a rotor mounted on said actuating shaft for rotation therewith in said chamber, said rotor defining a plurality of compression surfaces circumferentially spaced about the axis of rotation of said rotor radially equidistant therefrom, said internal chamber defining a confining surface spaced from said rotor so that rotation of said rotor effects engagement of successive compression surfaces with said conduit to form moving regions of occlusion along said conduit and move fluent material confined between successive regions of occlusion along said conduit, unidirectional drive means interposed between said rotor and said actuating shaft so that movement of said operating handle in a first predetermined rotational direction effects a corresponding rotational movement of said rotor in said predetermined rotational direction, and stop means on said housing limiting the extent of pivotal movement of said operating handle relative to said housing so as to effect a quarter revolution of said rotor for each pivotal movement of said operating handle between said stop means in a discharge direction.

14. A dispensing pump comprising a housing defining an internal chamber, a compressible tubular conduit having a portion disposed within said chamber and being adapted to pass a fluent material therethrough in a predetermined direction from a source externally of said housing, an actuating shaft rotatably supported by said housing and extending into said chamber, a rotor mounted on said actuating shaft for rotation therewith, said rotor defining a plurality of compression lobes equidistantly circumferentially spaced about its axis of rotation and having compression surfaces formed on said lobes in equal radially spaced relation from said axis of rotation, said internal chamber defining a confining surface spaced from said rotor such that said conduit is engaged by said compression surfaces during rotation of said actuating shaft in a first rotational direction so as to form moving regions of occlusion along the said conduit operative to move fluent material confined between successive regions of occlusion along said conduit in said predetermined direction, and means supported within said internal chamber and operatively associated with said rotor to effect rotation thereof in a direction opposite to said first rotational direction after each discharge cycle so as to effect a drawback of fluent material within said conduit downstream from said rotor.

15. A dispensing apparatus for dispensing fluent material in successive predetermined identical quantity units, said apparatus including a frame, a reservoir mounted on said frame and adapted to contain a bulk quantity of fluent material, a dispensing pump mounted on said frame, said pump including a pump housing having an internal chamber and first and second openings communicating with said internal chamber, a compressible tubular conduit passing through said openings and having a portion disposed within said internal chamber, said conduit having a first end portion communicating with said reservoir and having a second end portion defining a discharge opening, actuating shaft means rotatably supported by said housing and extending into said chamber, rotor means supported by said actuating shaft means within said internal chamber and having a plurality of compression lobes thereon adapted to engage said conduit and effect a peristaltic pumping action thereon so as to move said fluent material therethrough upon rotation of said rotor means in a predetermined direction, operating handle means operatively associated with said actuating shaft for effecting rotation thereof, unidirectional drive means interconnecting said actuating shaft means and said rotor means so that movement of said operating handle means from a first to a second position effects rotation of said rotor means in said predetermined direction to effect discharge through said discharge opening, and means supported within said housing and operatively associated with said rotor means so as to effect a slight reverse rotation of said rotor means following each incremental discharge of fluent material from said pump whereby to effect a drawback of fluent material from said discharge opening and prevent dripping therefrom.

* * * * *